US010435830B2

(12) United States Patent
Yu

(10) Patent No.: US 10,435,830 B2
(45) Date of Patent: Oct. 8, 2019

(54) BUTTONHOLE SEWING GUIDING DEVICE OF A SEWING MACHINE

(71) Applicant: ZENG HSING INDUSTRIAL CO., LTD., Taichung (TW)

(72) Inventor: Chia-Hui Yu, Taichung (TW)

(73) Assignee: ZENG HSING INDUSTRIAL CO., LTD., Taichung (TW)

( * ) Notice: Subject to any disclaimer, the term of this patent is extended or adjusted under 35 U.S.C. 154(b) by 98 days.

(21) Appl. No.: 15/867,869

(22) Filed: Jan. 11, 2018

(65) Prior Publication Data

US 2019/0055685 A1 Feb. 21, 2019

(30) Foreign Application Priority Data

Aug. 17, 2017 (TW) ..... 106127920 A

(51) Int. Cl.

| | |
|---|---|
| ***D05B 3/06*** | (2006.01) |
| ***D05B 3/02*** | (2006.01) |
| ***D05B 19/00*** | (2006.01) |
| ***D05B 19/14*** | (2006.01) |
| *A41F 1/02* | (2006.01) |

(52) U.S. Cl.

CPC ..... *D05B 3/06* (2013.01); *D05B 3/02* (2013.01); *D05B 19/00* (2013.01); *D05B 19/14* (2013.01); *A41F 1/02* (2013.01); *D05D 2303/40* (2013.01)

(58) Field of Classification Search

CPC ... D05B 3/06; D05B 3/02; D05B 3/08; D05B 3/10; D05B 3/12; D05B 19/00; D05B 19/12; D05B 19/14; D05B 19/16; A41F 1/00; A41F 1/02; D05D 2303/14; D05D 2303/40

See application file for complete search history.

(56) References Cited

U.S. PATENT DOCUMENTS

| | | | | | |
|---|---|---|---|---|---|
| 4,056,070 | A * | 11/1977 | Hauf | D05B 3/06 | 112/235 |
| 4,182,249 | A * | 1/1980 | Matumura | D05B 3/24 | 112/447 |
| 4,242,976 | A * | 1/1981 | Beckerman | D05B 3/24 | 112/475.25 |
| 4,409,913 | A * | 10/1983 | Adams | D05B 3/24 | 112/446 |
| 4,953,486 | A * | 9/1990 | Sano | D05B 3/06 | 112/235 |
| 8,100,069 | B2 * | 1/2012 | Asaba | D05B 3/06 | 112/447 |
| 9,145,631 | B2 | 9/2015 | Kawai | | |

FOREIGN PATENT DOCUMENTS

JP 01110394 A * 4/1989

* cited by examiner

*Primary Examiner* — Ismael Izaguirre
(74) *Attorney, Agent, or Firm* — Burris Law, PLLC

(57) ABSTRACT

A buttonhole sewing guiding device of a sewing machine includes a buttonhole presser foot unit disposed on a presser foot holder of the sewing machine, and a sensing unit disposed on the buttonhole presser foot unit. A presser frame of the foot unit is movable relative to a sliding member between first and second sewing positions set in accordance with an operating distance that corresponds to a size of a button to allow first and second triggering members to initiate a sensing module for controlling operation of a sewing needle.

10 Claims, 12 Drawing Sheets

BUTTONHOLE SEWING GUIDING DEVICE OF A SEWING MACHINE

CROSS-REFERENCE TO RELATED APPLICATION

This application claims priority of Taiwanese Patent Application No. 106127920, filed on Aug. 17, 2017.

FIELD

The disclosure relates to a sewing machine, and more particularly to a buttonhole sewing guiding device of a sewing machine.

BACKGROUND

A conventional sewing machine adapted to perform a buttonhole sewing operation needs to have the sewing length around a buttonhole adjusted according to the diameter of a button. Thus, a buttonhole presser is mounted on a presser foot holder of the sewing machine with a buttonhole switch mechanism incorporated in a head portion of the sewing machine, such as that disclosed in U.S. Pat. No. 9,145,631, for sewing a buttonhole. When a button is placed on the buttonhole presser, a buttonhole switching lever of the switch mechanism is pulled down to contact the buttonhole presser between two lever operating arms such that, during movement of a presser frame of the buttonhole presser together with a cloth in a front-and-rear direction, one of the lever operating arms contacts the buttonhole switching lever so as to initiate a detection switch, which submits a signal to a central process unit of the sewing machine to control the sewing operation. However, such buttonhole switch mechanism occupies a large space of the head portion of the sewing machine, and increases time and cost of assembling the sewing machine. Moreover, the pulled buttonhole switching lever is liable to break accidentally.

Another conventional sewing machine with a buttonhole presser which can measure a diameter of a button, such as model Designer Topaz 40 produced by Husqvarna Viking Sewing Machine Company, or model Bernina 580 produced by Bernina Sewing Machine Company, is used to perform a buttonhole sewing operation. However, a user needs to manually measure a diameter of a button and input the measured data into a central process unit of the sewing machine via a human-machine interface to determine the sewing length of the buttonhole, which results in inconvenience during use.

SUMMARY

Therefore, an object of the disclosure is to provide a buttonhole sewing guiding device of a sewing machine that can alleviate at least one of the drawbacks of the prior arts.

According to the disclosure, the buttonhole sewing guiding device of a sewing machine which has a sewing needle operative for sewing a buttonhole in a fabric, a presser foot holder for pressing the fabric, and a central process unit, includes a buttonhole presser foot unit and a sensing unit. The buttonhole presser foot unit includes a presser frame, a button guiding plate adjustably disposed on the presser frame in a front-and-rear direction, and a sliding member movably disposed on the presser frame in the front-and-rear direction. The presser frame has a frame front end portion and a frame rear end portion. The button guiding plate has a plate front end portion and a plate rear end portion, and is movable relative to the presser frame in the front-and-rear direction between a non-use position, where the plate front end portion is proximate to the frame front end portion, and a use position, where the plate front end portion is distal from the frame front end portion and spaced apart from the frame front end portion by a gap interval that corresponds to a diameter of a button. The sliding member is detachably connected to the presser foot holder such that the presser frame is movable relative to the sliding member between a first sewing position, where the sliding member is proximate to the frame rear end portion and distal from the button guiding plate, and a second sewing position, where the sliding member is distal from the frame rear end portion and proximate to the button guiding plate. The sensing unit includes a sensing module which is disposed on the sliding member and in signal connection with the central process unit, a first triggering member which is disposed on the presser frame such that, when the presser frame is in the first sewing position, the first triggering member initiates the sensing module to transmit a first signal to the central process unit for controlling operation of the sewing needle in a first mode, and a second triggering member which is disposed on the button guiding plate such that, when the presser frame is in the second sewing position, the second triggering member initiates the sensing module to transmit a second signal to the central process unit for controlling operation of the sewing needle in a second mode.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
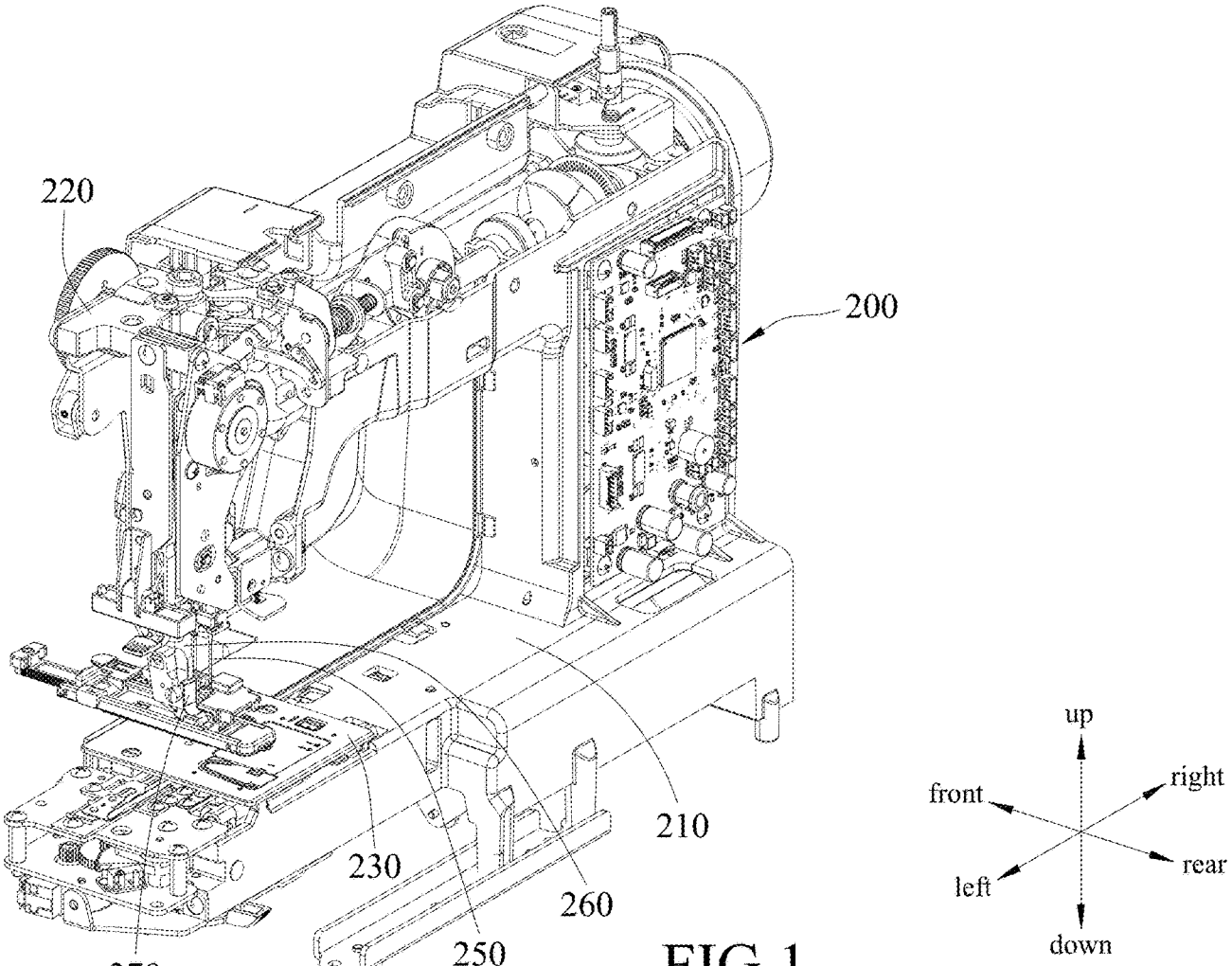
FIG. 1 is a perspective view illustrating an embodiment of a buttonhole sewing guiding device according to the disclosure mounted on a presser foot holder of a sewing machine.
Figure 2:
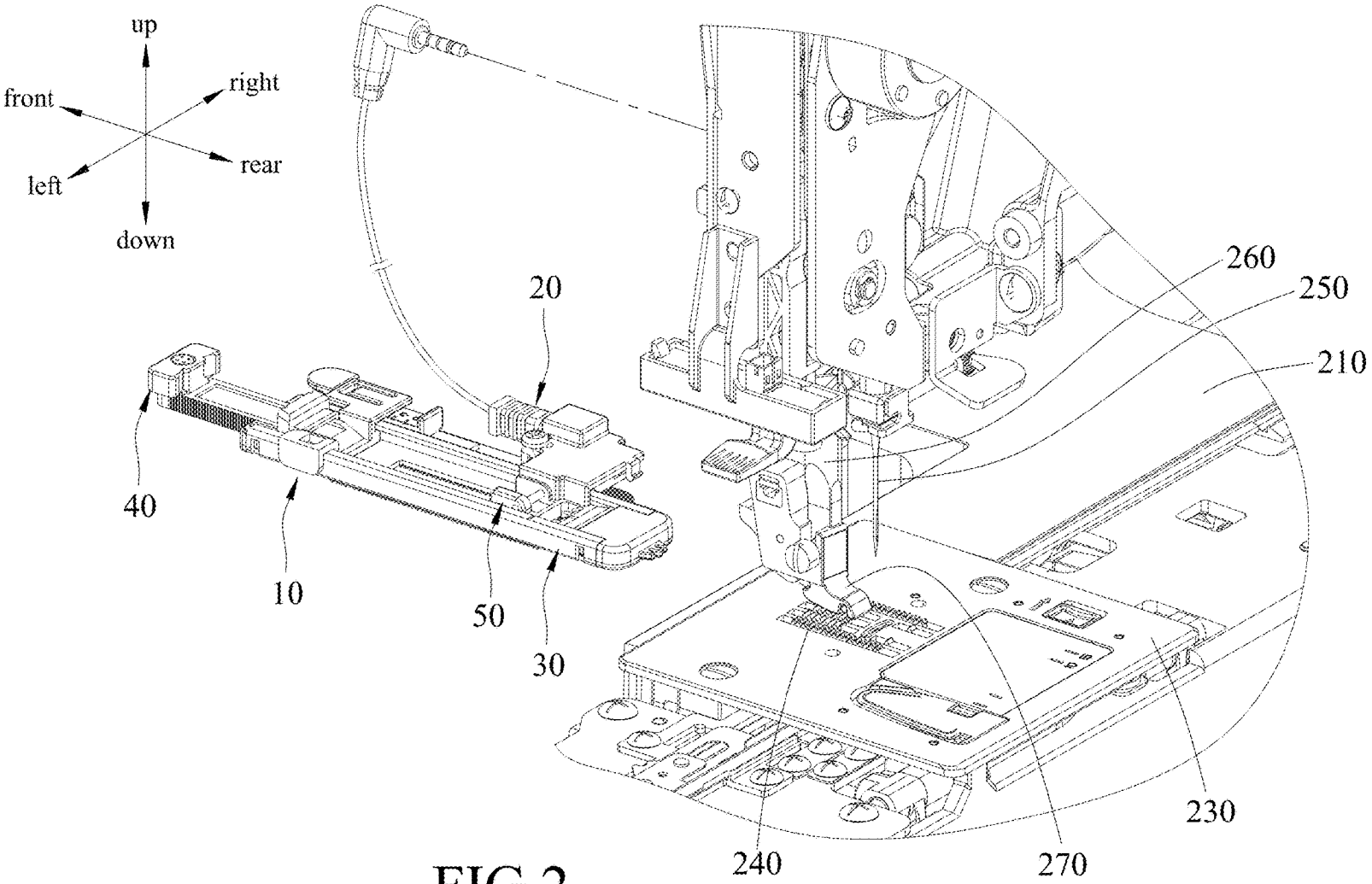
FIG. 2 is a fragmentary perspective view illustrating the embodiment removed from the presser foot holder.
Figure 3:
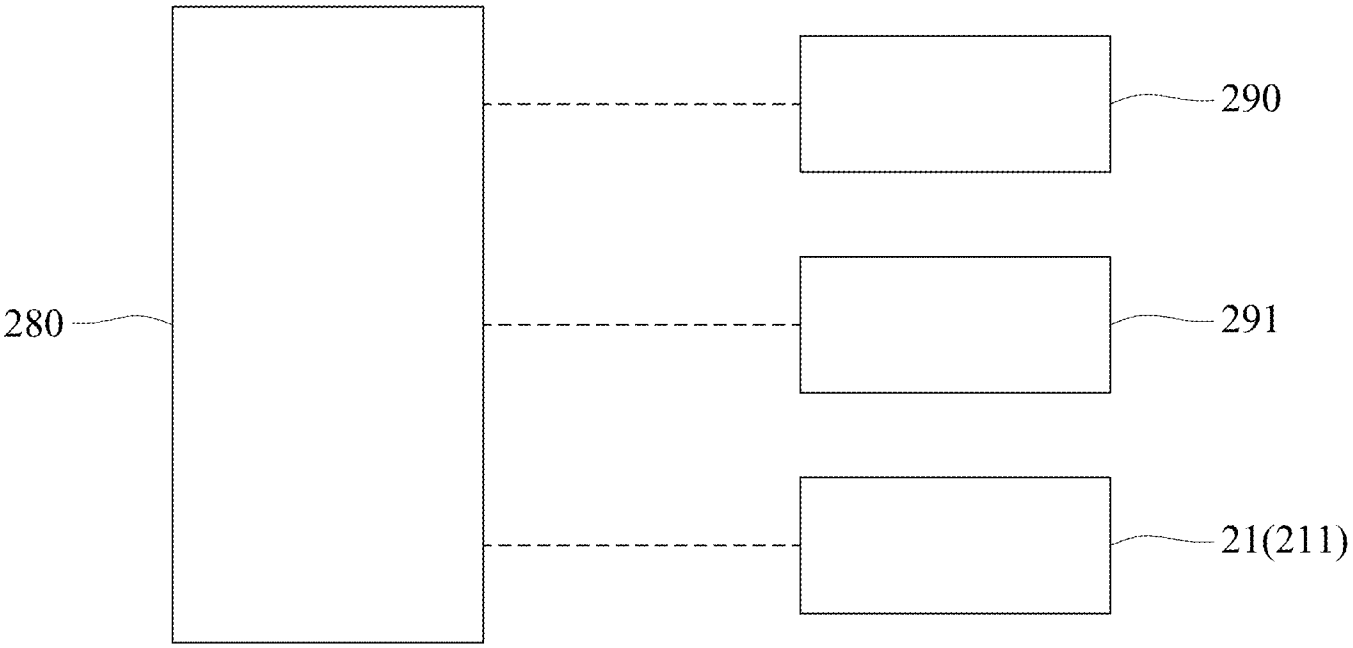
FIG. 3 is a block diagram of a control system of the sewing machine.

FIGS. 1 to 3 illustrate an embodiment of a buttonhole sewing guiding device of a sewing machine. In this embodiment, the sewing machine 200 has a bed 210, a head 220 connected with the bed 210, a needle plate 230 disposed on the bed 210, a feed dog 240 disposed on the bed 210 and operative to feed a fabric 300 (see FIG. 16) in a front-and-rear direction, a sewing needle 250 disposed on the head 220 and operative for sewing a buttonhole in the fabric 300, a presser foot 260 disposed on the head 220, a presser foot holder 270 disposed on a bottom end of the presser foot 260 for pressing the fabric, a central process unit 280, a dog driving unit 290 electrically connected with the central process unit 280 for driving the feed dog 240, and a needle driving unit 291 electrically connected with the central process unit 280 for driving the sewing needle 250 to move in an up-and-down direction, and in the front-and-rear direction or a left-and-right direction relative to the fabric for a sewing operation. Each of the dog driving unit 290 and the needle driving unit 291 may be a step motor. The front, rear, left, right, up and down directions described herein are referred to as those when a user faces and uses the sewing machine 200 as shown in FIG. 1.

Figure 4:
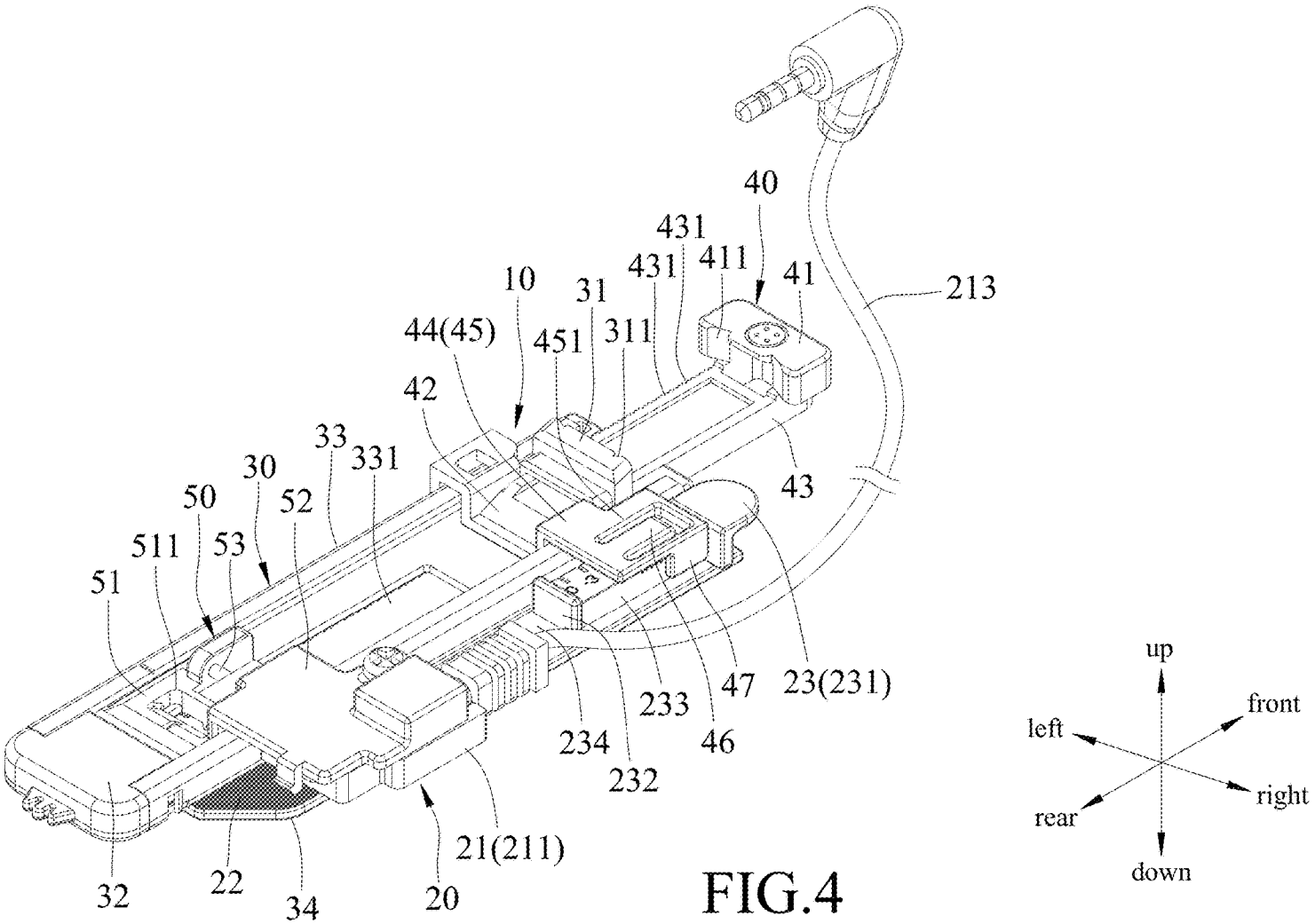
FIG. 4 is a fragmentary perspective view of the embodiment.
Figure 5:
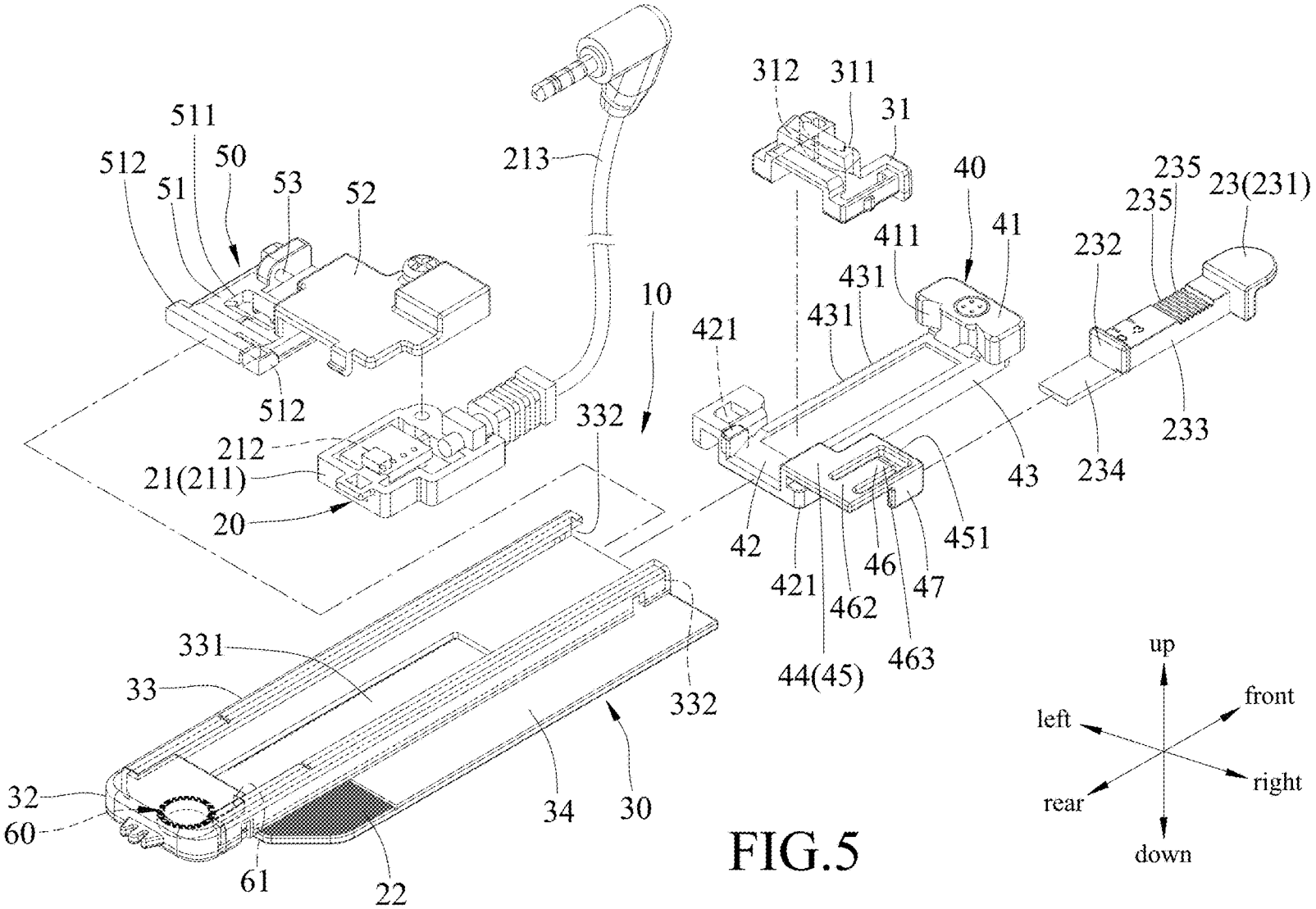
FIG. 5 is a fragmentary, exploded perspective view of the embodiment.
Figure 6:
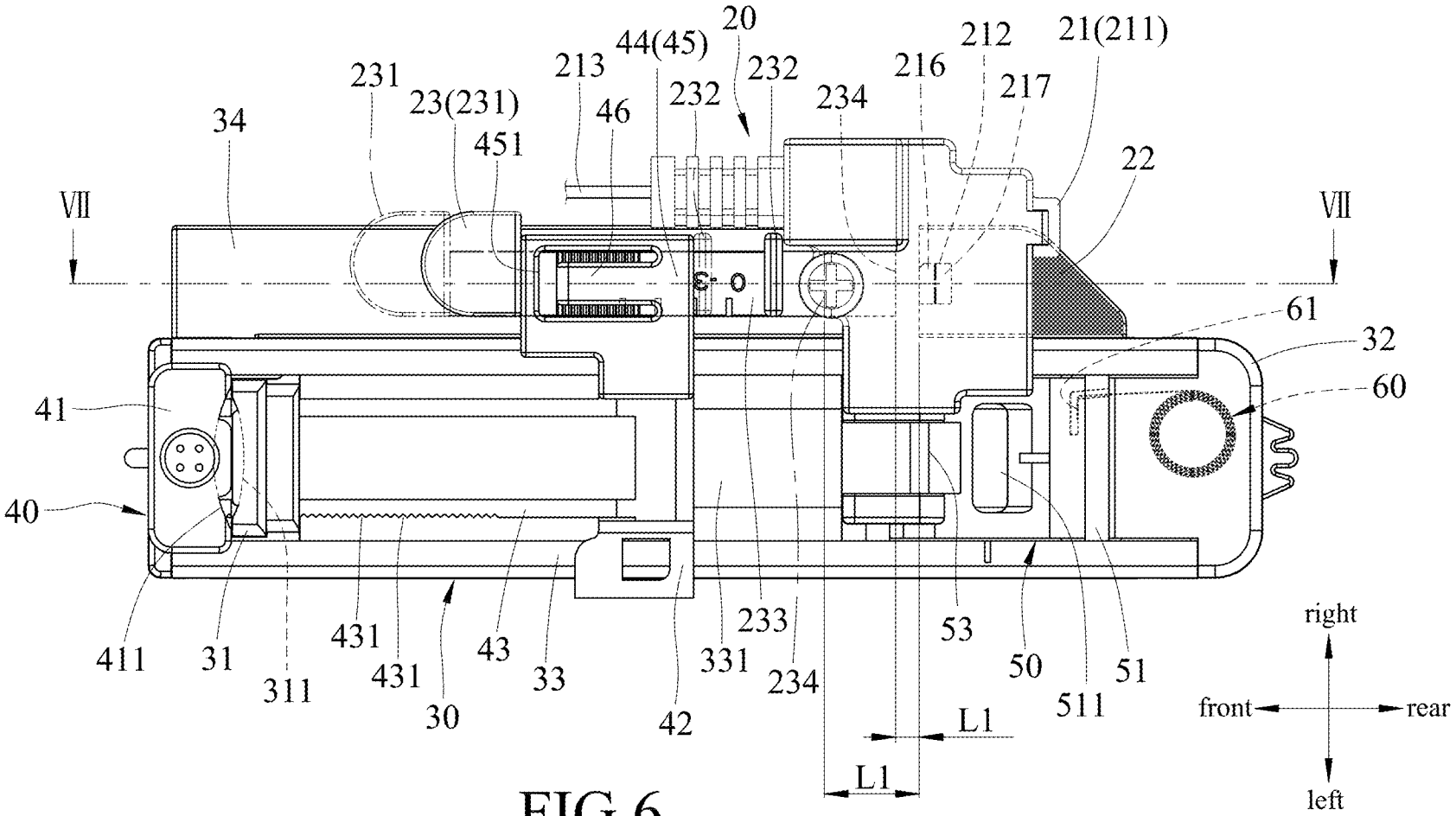
FIG. 6 is a fragmentary top view illustrating a state where a presser frame of the embodiment is in a first sewing position, and a button guiding plate is in a non-use position.

Referring to FIGS. 4 to 6, the buttonhole sewing guiding device includes a buttonhole presser foot unit 10 and a sensing unit 20.

The buttonhole presser foot unit 10 includes a presser frame 30, a button guiding plate 40 adjustably disposed on the presser frame 30 in the front-and-rear direction, a sliding member 50 movably disposed on the presser frame 30 in the front-and-rear direction, and a biasing member 60 disposed between the presser frame 30 and the sliding member 50.

The presser frame 30 has a frame front end portion 31, a frame rear end portion 32, a frame middle portion 33, and a lateral plate portion 34 elongated in the front-and-rear direction and disposed laterally of the frame front end portion 31, the frame rear end portion 32 and the frame middle portion 33. The frame front end portion 31 has a button contact surface 311 facing forwardly, and a positioning protrusion 312. The frame middle portion 33 has a penetrating slot 331 which is formed between the frame front end portion 31 and the frame rear end portion 32 and elongated in the front-and-rear direction, and two guide rails 332 which are respectively disposed at two sides of the penetrating slot 331 and parallel to the penetrating slot 331.

The button guiding plate 40 has a plate front end portion 41, a plate rear end portion 42, a plate middle portion 43, and a lateral seat portion 44 which extends in the left-and-right direction from the plate rear end portion 42 and which is disposed above the lateral plate portion 34. In this embodiment, the plate front end portion 41 has a button contact surface 411 facing rearwardly. The plate rear end portion 42 has two guided blocks 421 respectively sliable on and along the guide rails 332. The plate middle portion 43 has a plurality of teeth 431 displaced from one another in the front-and-rear direction at aside thereof. The lateral seat portion 44 has an upper wall 45 which is connected to the plate rear end portion 42 and formed with a penetrating hole 451, a resilient flap 46 which is disposed in the penetrating hole 451 and has a fixed end 462 integrally connected to the upper wall 45, a free end 463 opposite to the fixed end 462, and a resilient protrusion 461 (see FIG. 7) formed on and extending downwardly from the free end 463, and two guide lateral walls 47 which are disposed on and extend downwardly from an underside of the upper wall 45 and which are spaced apart from each other in the left-and-right direction. With the engagement of the positioning protrusion 312 with a selected one of the teeth 431, the button guiding plate 40 is positioned on the presser frame 30 in the front-and-rear direction.

Figure 9:
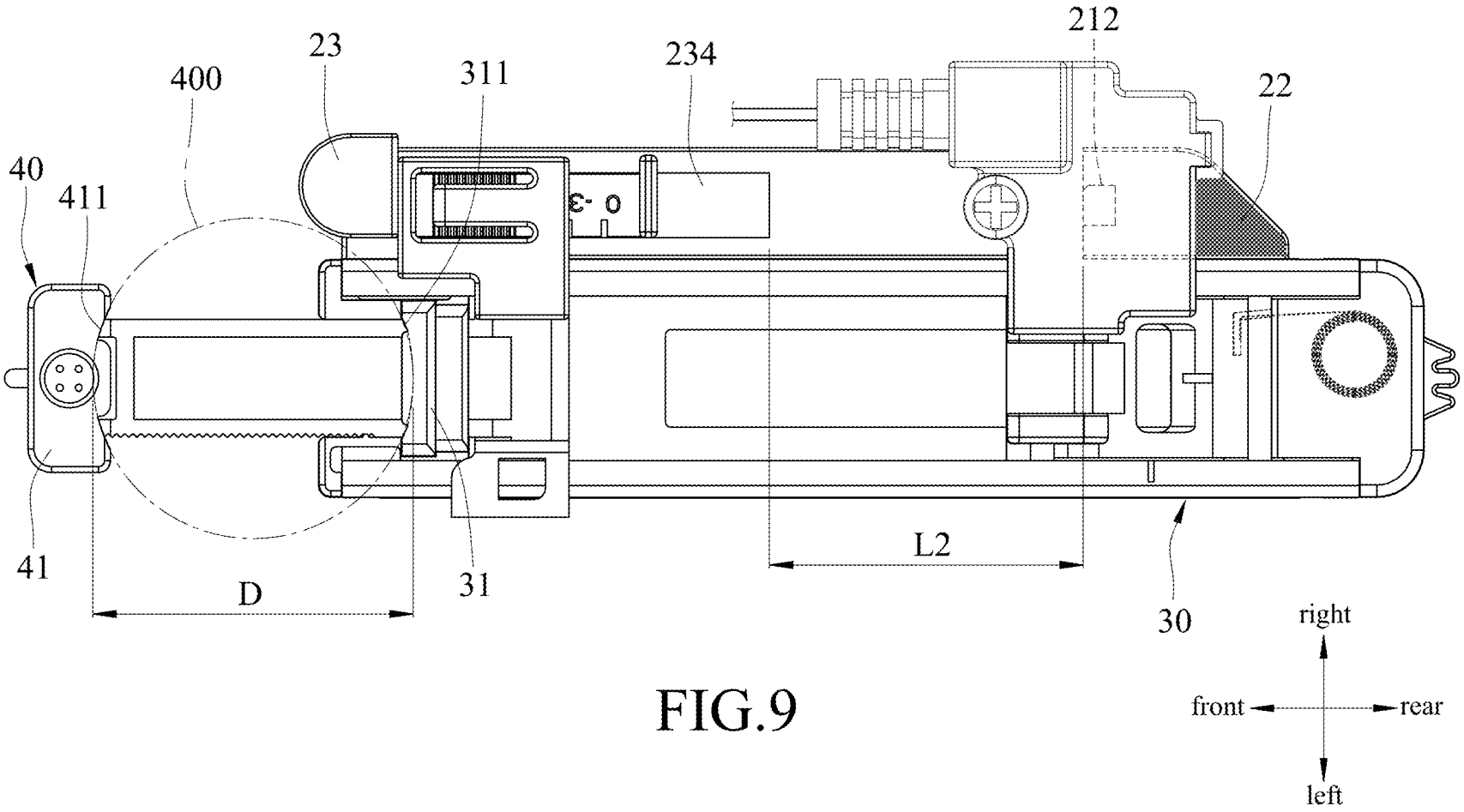
FIG. 9 is a view similar to FIG. 6, illustrating a state where the presser frame is in the first sewing position, and the button guiding plate is in a use position.

With reference to FIGS. 6 and 9, the button guiding plate 40 is movable relative to the presser frame 30 in the front-and-rear direction between a non-use position (see FIG. 6), where the plate front end portion 41 is proximate to the frame front end portion 31, and a use position (see FIG. 9), where the plate front end portion 41 is distal from the frame front end portion 31. A button 400 is placed and sandwiched between the button contact surfaces 411, 311 such that the plate front end portion 41 is spaced apart from the frame front end portion 31 by a gap interval (D) that corresponds to the diameter of the button 400.

Referring to FIGS. 4 to 6, in this embodiment, the sliding member 50 has a sliding seat 51 disposed on the presser frame 30, a mounting wall 52 extending in the left-and-right direction from the sliding seat 51 and disposed upwardly of the presser frame 30 (see FIG. 7), and a connecting rod 53 disposed on the sliding seat 51 and extending in the left-and-right direction for removably connecting with the presser foot holder 270 (see FIG. 2). The sliding seat 51 is formed with a sewing opening 511 aligned with the penetrating slot 331 for passage of the sewing needle 250 (see FIG. 2). The sliding seat 51 has two guided portions 512 respectively slidable on and along the guide rails 332.

Figure 10:
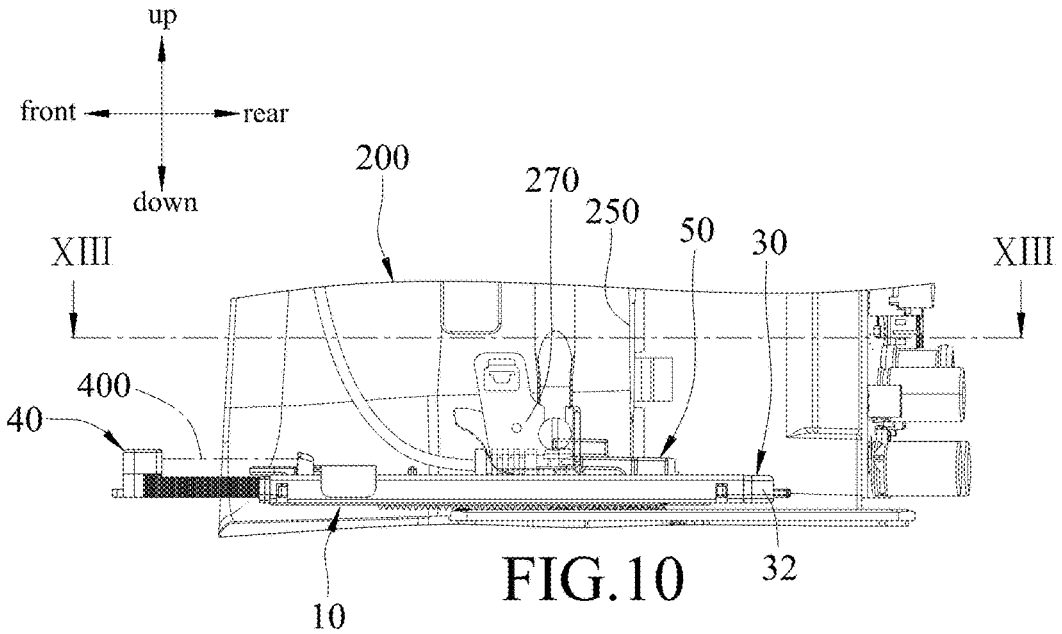
FIG. 10 is a fragmentary side view illustrating a state where the embodiment is mounted on the presser foot holder, and the presser frame is in the first sewing position.
Figure 11:
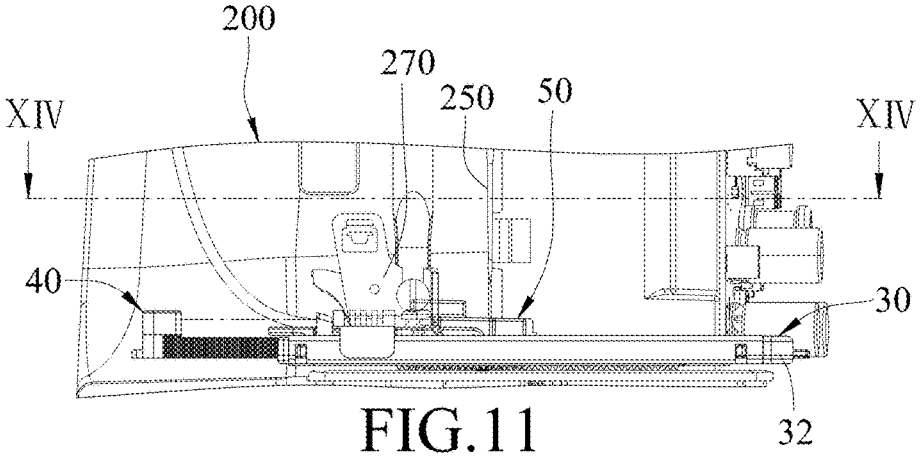
FIG. 11 is a view similar to FIG. 10, illustrating a state where the presser frame is moved rearwardly relative to the presser foot holder to a second sewing position.

With reference to FIGS. 10 and 11, the sliding member 50 is detachably connected to the presser foot holder 270 such that the presser frame 30 is movable relative to the sliding member 50 between a first sewing position (see FIG. 10), where the sliding member 50 is proximate to the frame rear end portion 32 and distal from the button guiding plate 40, and a second sewing position (see FIG. 11), where the sliding member 50 is distal from the frame rear end portion 32 and proximate to the button guiding plate 40.

Referring to FIGS. 5 and 6, the biasing member 60 is disposed between the frame rear end portion 32 of the presser frame 30 and the sliding seat 51 of the sliding member 50 to bias the sliding member 50 toward the frame rear end portion 32. In this embodiment, the biasing member 60 is a scroll spring disposed in the frame rear end portion 32 and has a free end 61 connected to the sliding seat 51.

Referring back to FIGS. 4 to 6, the sensing unit 20 includes a sensing module 21 disposed on the sliding member 50, a first triggering member 22 disposed on the presser frame 30, and a second triggering member 23 disposed on the button guiding plate 40. In this embodiment, the sensing module 21 is a photosensor, such as a photo interrupter.

Figure 7:
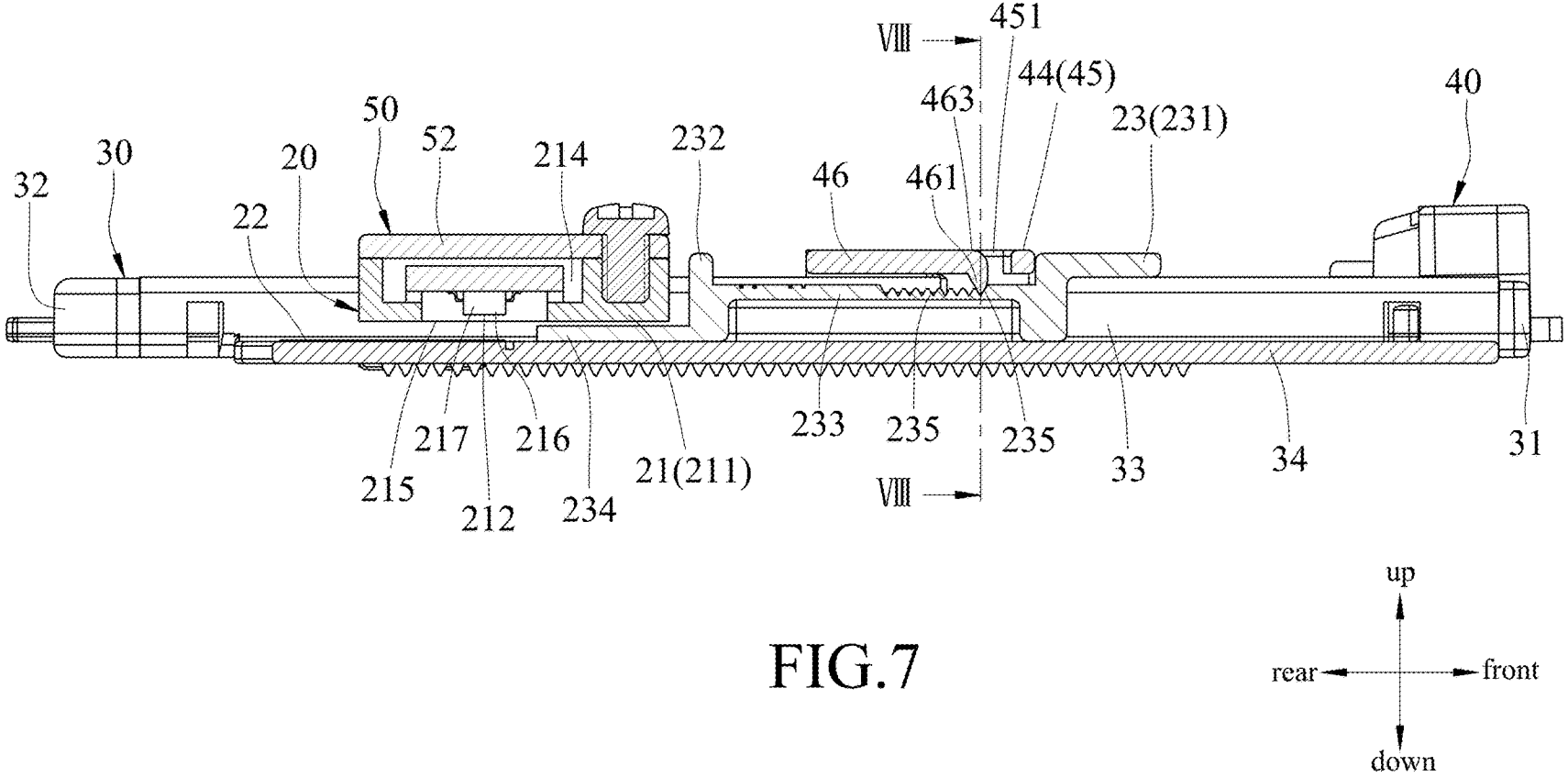
FIG. 7 is a sectional view taken along line VII-VII of FIG. 6.

With reference to FIGS. 5 to 7, in this embodiment, the sensing module 21 has a base seat 211 mounted on the sliding member 50, a reflective photoelectric switch 212 mounted on the base seat 211, and a signal cable 213 disposed on the base seat 211 and electronically connected between the reflective photoelectric switch 212 and the central process unit 280 (see FIG. 3) to establish communication therebetween. The base seat 211 is disposed on an underside of the mounting wall 52, and defines an accommodating chamber 214 which has a lower opening 215. The reflective photoelectric switch 212 is disposed in the accommodating chamber 214 to have a light emitting portion 216 and a light receiving portion 217 facing the lower opening 215. The light emitting portion 216 and the light receiving portion 217 are disposed as front and rear half parts of the reflective photoelectric switch 212, as indicated by a dotted line in FIG. 6. The reflective photoelectric switch 212 is in signal connection with the central process unit 280 via the cable 213. Alternatively, the sensing module 21 may be in signal connection with the central process unit 280 through wireless communication technologies or devices, such as radio frequency, Bluetooth, etc.

In this embodiment, the first triggering member 22 is a reflective layer which is attached to a top surface of the lateral plate portion 34 and adjacent to a rear end of the lateral plate portion 34, and which has a color (such as black color) different from that of the lateral plate portion 34.

Figure 8:
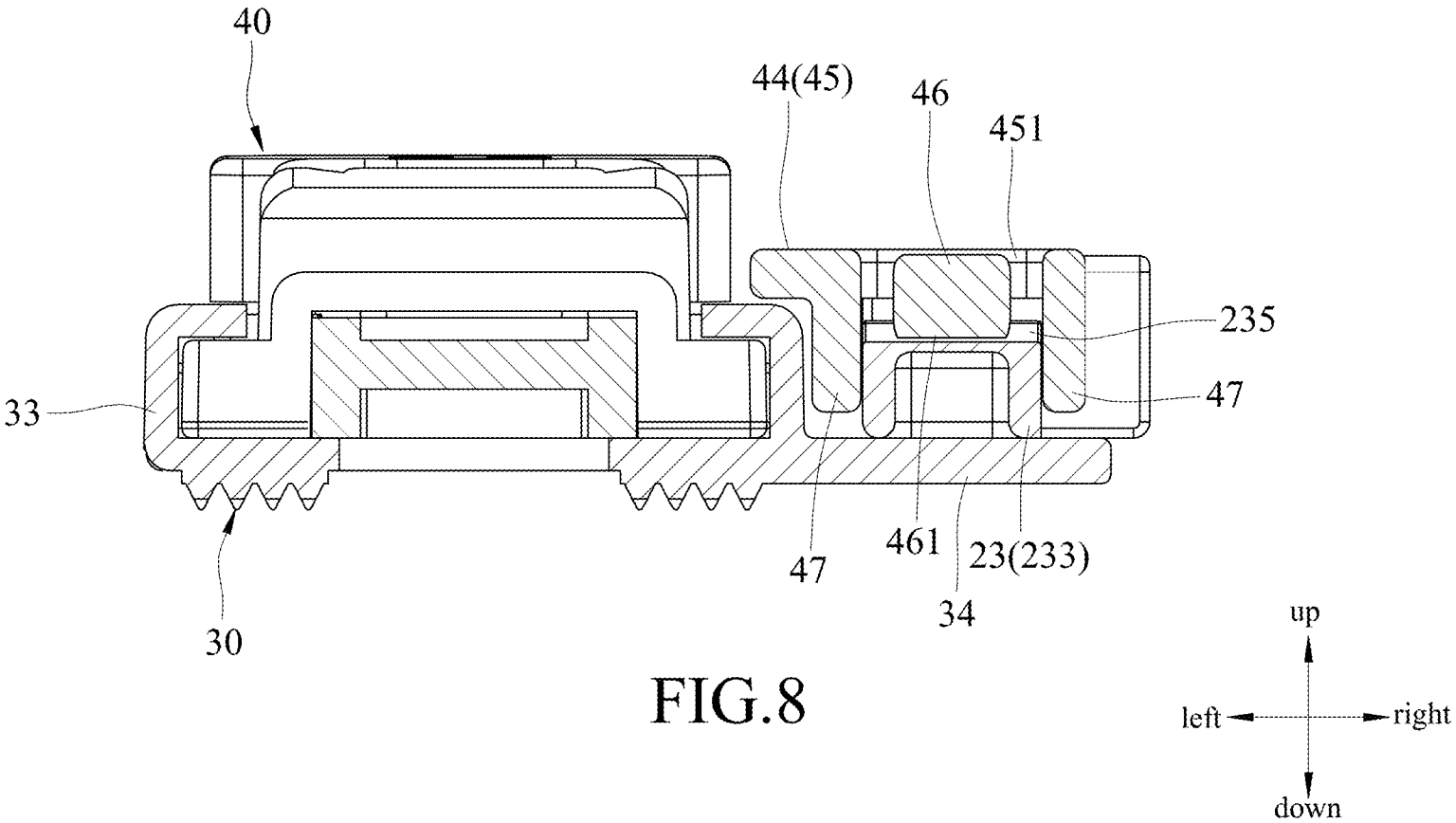
FIG. 8 is a sectional view taken along line VIII-VIII of FIG. 7.

In this embodiment, the second triggering member 23 is adjustably disposed on the lateral seat portion 44 of the button guiding plate 40 in the front-and-rear direction and in slidable contact with the top surface of the lateral plate portion 34. The second triggering member 23 has a front stop portion 231 which is disposed forwardly of the upper wall 45, a rear stop portion 232 which is disposed rearwardly of the upper wall 45, a connecting portion 233 which extends in the front-and-rear direction to interconnect the front and rear stop portions 231, 232 and which is disposed between the guide lateral walls 47 (see FIG. 8), and a reflective portion 234 which extends rearwardly from the rear stop portion 232 and which is interposed between the first triggering member 22 and the lateral seat portion 44 in the front-and-rear direction. The connecting portion 233 has a plurality of teeth 235 formed on an upper surface thereof and displaced from one another in the front-and-rear direction. With the engagement of the resilient protrusion 461 with a selected one of the teeth 235, the second triggering member 23 is retained to the button guiding plate 40. The reflective portion 234 has a color (such as black color) different from that of the lateral plate portion 34 of the presser frame 30. The second triggering member 23 may have a single color for facilitating injection forming.

Referring to FIG. 6, the reflective portion 234 of the second triggering member 23 is set to be distant from the reflective photoelectric switch 212 in the front-and-rear direction by a predetermined distance (L1) when the button guide plate 40 is in the non-use position and the presser frame 30 is in the first sewing position. The predetermined distance (L1) becomes the smallest (such as 2 mm) when the second triggering member 23 is adjusted in the front-and-rear direction relative to the lateral seat portion 44 to have the front stop portion 231 abutting against the front end of the upper wall 45, and becomes the largest (such as 4 mm) when the second triggering member 23 is adjusted in the front-and-rear direction relative to the lateral seat portion 44 to have the rear stop portion 232 abutting against the rear end of the upper wall 45. Referring to FIG. 9, when the button guide plate 40 is in the use position and the presser frame 30 is in the first sewing position, the reflective portion 234 of the second triggering member 23 is distant from the reflective photoelectric switch 212 in the front-and-rear direction by an operating distance (L2). The operating distance (L2) is the sum of the predetermined distance (L1) (see FIG. 6) and the gap interval (D). The sewing length of the buttonhole is determined by the operating distance (L2).

Figure 13:
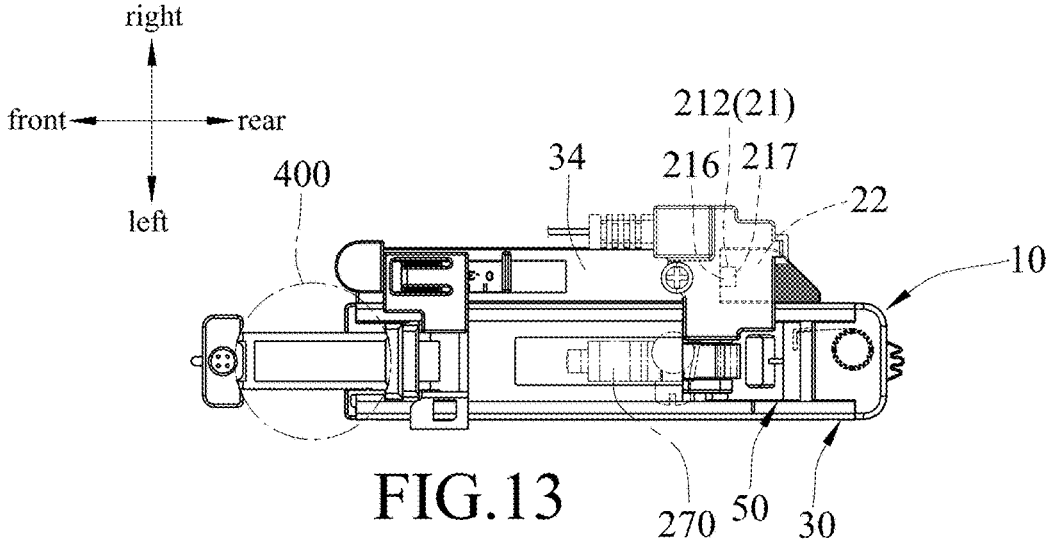
FIG. 13 is a sectional view taken along line XIII-XIII of FIG. 10.
Figure 14:
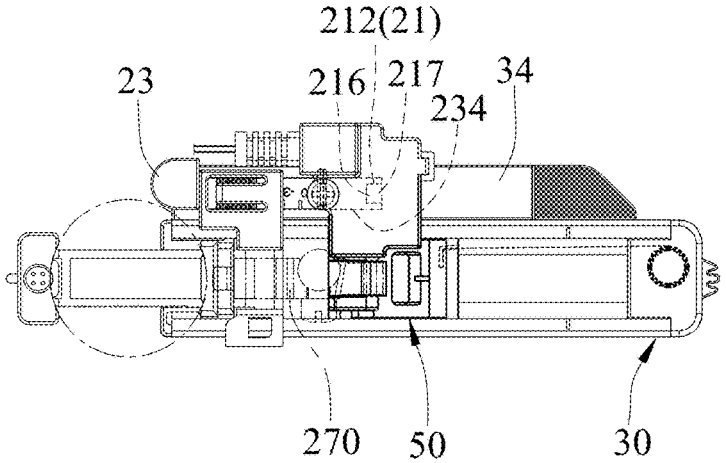
FIG. 14 is a sectional view taken along line XIV-XIV of FIG. 11.

Referring to FIGS. 10 and 13, in this embodiment, when the presser frame 30 is in the first sewing position, light emitted from the light emitting portion 216 of the reflective photoelectric switch 212 is reflected by the first triggering member 22, and the reflected light enters the light receiving portion 217 to allow the reflective photoelectric switch 212 to transmit a first signal to the central process unit 280 (see FIG. 3) for controlling operation of the sewing needle 250 in a first mode. Referring to FIGS. 11 and 14, when the presser frame 30 is in the second sewing position, light emitted from the light emitting portion 216 is reflected by the second triggering member 23, and the reflected light enters the light receiving portion 217 to allow the reflective photoelectric switch 212 to transmit a second signal to the central process unit 280 for controlling operation of the sewing needle 250 in a second mode. Since the lateral plate portion 34 of the presser frame 30 has the color different from those of both the first triggering member 22 and the reflective portion 234 of the second triggering member 23, the reflective photoelectric switch 212 is not initiated to transmit a signal to the central process unit 280 when the reflective photoelectric switch 212 is placed above a region in the lateral plate portion 34 where the first triggering member 22 is not attached thereon due to a difference in the amount of light reflection.

Figure 12:
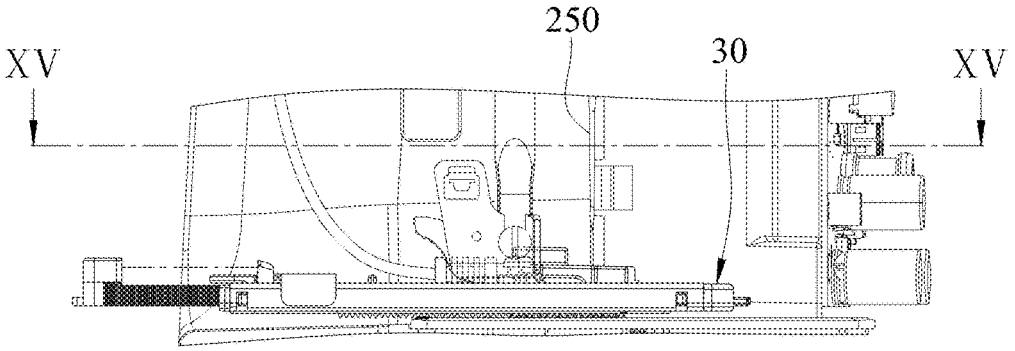
FIG. 12 is a view similar to FIG. 11, illustrating a state where the presser frame is moved forwardly relative to the presser foot holder back to the first sewing position.
Figure 15:
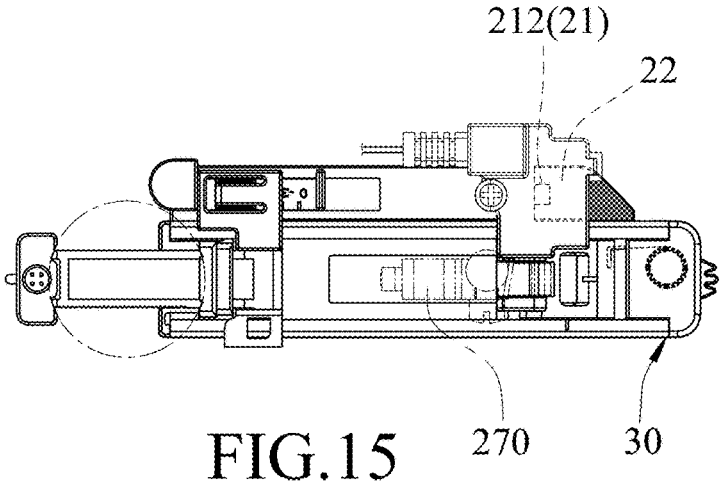
FIG. 15 is a sectional view taken along line XV-XV of FIG. 12.
Figure 16:
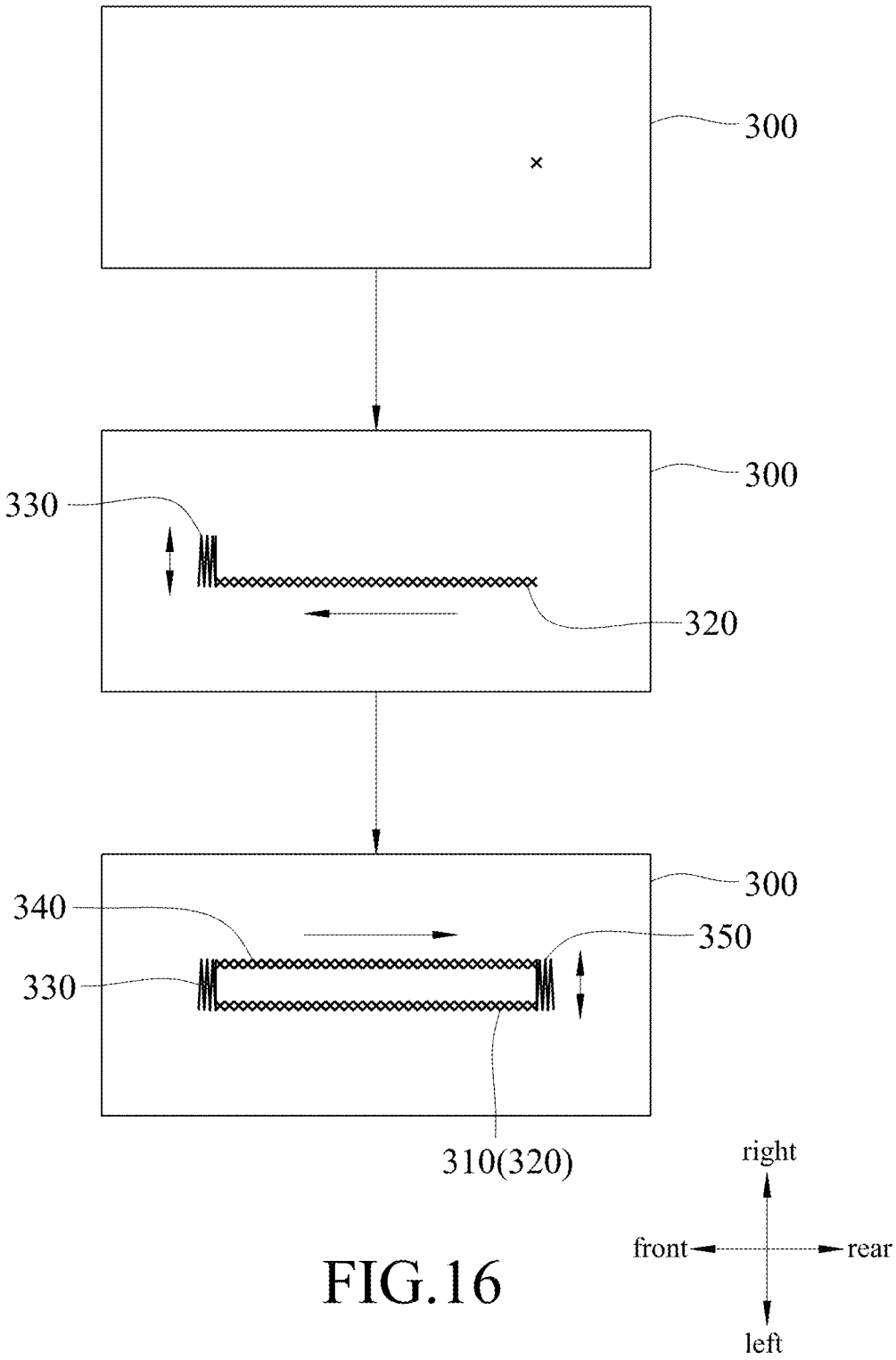
FIG. 16 is a schematic view illustrating a buttonhole sewing procedure of the sewing machine equipped with the embodiment.

Thus, with reference to FIGS. 10, 13 and 16, when it is desired to sew a buttonhole 310 on a fabric 300, the buttonhole presser foot unit 10 is first mounted on the presser foot holder 270 of the sewing machine 200. At this time, the first triggering member 22 initiates the reflective photoelectric switch 212 of the sensing module 21 to transmit a signal to the central process unit 280 to set the presser frame 30 in the first sewing position ready to perform a sewing operation. Next, referring to FIGS. 11, 14 and 16, a foot pedal (not shown) of the sewing machine 200 is operated to drive the feed dog 240 for moving the fabric 300 in the front-and-rear direction such that the presser frame 30 is moved therewith to the second sewing position. During the movement, by control of the central process unit 280, the needle 250 is driven to perform a straight sewing action to form a long side 320 of the buttonhole 310. Once the reflective portion 234 of the second triggering member 23 initiates the reflective photoelectric switch 212 of the sensing module 21 to transmit a signal to the central process unit 280, the needle 250 is driven to perform a sewing action to form a short side 330 of the buttonhole 310. Subsequently, referring to FIGS. 12, 15 and 16, the feed dog 240 is driven to reverse in direction to move the fabric 300 and the presser frame 30 back to the first sewing position. During this movement, the needle 250 is driven to perform a straight sewing action to form a long side 340 of the buttonhole 310. Once the first triggering member 22 initiates again the reflective photoelectric switch 212 of the sensing module 21 to transmit a signal to the central process unit 280, the needle 250 is driven to perform a sewing action to form a short side 350 of the buttonhole 310. Hence, a sewing operation of the buttonhole 310 is completed. The length of each long side 320, 340 substantially corresponds to the operating distance (L2), i.e., the sum of the diameter of the buttonhole 400 and the predetermined distance (L1). With the predetermined distance (L1), the button 400 can easily pass through the buttonhole 310. It should be noted that the sewing mode and order of operation for forming the buttonhole can be modified and varied, and are not limited to the above-mentioned embodiment.

As illustrated, with the sensing unit 20 disposed on the buttonhole presser foot unit 10, the sewing machine 200 equipped with the embodiment can perform a buttonhole sewing operation without the need for incorporating a buttonhole switch mechanism on the head 220 of the sewing machine, which reduces the manufacturing time and cost of the sewing machine, and increases space available around the head 220. Also, the signal cable 213 of the sensing unit 20 can be designed to share an electric socket of the sewing machine 200. Moreover, with a button 400 sandwiched between the plate front end portion 41 and the frame front end portion 31, the operating distance (L2) can be automatically set between the reflective portion 234 of the second triggering member 23 and the reflective photoelectric switch 212 to determine the length of the long side 320, 340. Hence, once the user places the button 400 on the buttonhole presser foot unit 10, a buttonhole sewing operation can be carried out by the sewing machine 200 without the need to measure the diameter of the button and to input the value into the sewing machine 200, thereby increasing convenience during use.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A buttonhole sewing guiding device of a sewing machine which has a sewing needle operative for sewing a buttonhole in a fabric, a presser foot holder for pressing the fabric, and a central process unit, comprising:

a buttonhole presser foot unit including a presser frame, a button guiding plate adjustably disposed on said presser frame in a front-and-rear direction, and a sliding member movably disposed on said presser frame in the front-and-rear direction, said presser frame having a frame front end portion and a frame rear end portion, said button guiding plate having a plate front end portion and a plate rear end portion and being movable relative to said presser frame in the front-and-rear direction between a non-use position, where said plate front end portion is proximate to said frame front end portion, and a use position, where said plate front end portion is distal from said frame front end portion and spaced apart from said frame front end portion by a gap interval that corresponds to a diameter of a button, said sliding member being detachably connected to the presser foot holder such that said presser frame is movable relative to said sliding member between a first sewing position, where said sliding member is proximate to said frame rear end portion and distal from said button guiding plate, and a second sewing position, where said sliding member is distal from said frame rear end portion and proximate to said button guiding plate; and a sensing unit including a sensing module which is disposed on said sliding member and which is in signal connection with the central process unit, a first triggering member which is disposed on said presser frame such that, when said presser frame is in the first sewing position, said first triggering member initiates said sensing module to transmit a first signal to the central process unit for controlling operation of the sewing needle in a first mode, and a second triggering member which is disposed on said button guiding plate such that, when said presser frame is in the second sewing position, said second triggering member initiates said sensing module to transmit a second signal to the central process unit for controlling operation of the sewing needle in a second mode.

2. The buttonhole sewing guiding device as claimed in claim 1, wherein said sensing module is a photosensor.

3. The buttonhole sewing guiding device as claimed in claim 2, wherein said sensing module has a base seat mounted on said sliding member, and a reflective photoelectric switch mounted on said base seat and having a light emitting portion and a light receiving portion such that, when said presser frame is in the first sewing position, light emitted from said light emitting portion is reflected by said first triggering member and the reflected light enters said light receiving portion to allow said reflective photoelectric switch to transmit the first signal to the central process unit, and such that, when said presser frame is in the second sewing position, light emitted from said light emitting portion is reflected by said second triggering member and the reflected light enters said light receiving portion to allow said reflective photoelectric switch to transmit the second signal to the central process unit.

4. The buttonhole sewing guiding device as claimed in claim 3, wherein said presser frame further has a lateral plate portion elongated in the front-and-rear direction and disposed laterally of said frame front end portion and said frame rear end portion, said first triggering member being a reflective layer which is attached to a top surface of said lateral plate portion and adjacent to a rear end of said lateral plate portion to reflect the light emitted from said light emitting portion to said light receiving portion when said presser frame is in the first sewing position, said button guiding plate further having a lateral seat portion which extends in a left-and-right direction from said plate rear end portion and which is disposed above said lateral plate portion, said second triggering member being adjustably disposed on said lateral seat portion in the front-and-rear direction and in slidable contact with said top surface of said lateral plate portion, said second triggering member having a reflective portion which is interposed between said first triggering member and said lateral seat portion in the front-and-rear direction to reflect the light emitted from said light emitting portion to said light receiving portion when said presser frame is in the second sewing position.

5. The buttonhole sewing guiding device as claimed in claim 4, wherein said sliding member has a sliding seat disposed on said presser frame, and a mounting wall extending in the left-and-right direction from said sliding seat and disposed upwardly of said presser frame, said base seat of said sensing module being disposed on an underside of said mounting wall and defining an accommodating chamber which has a lower opening, said reflective photoelectric switch being disposed in said accommodating chamber to have said light emitting portion and said light receiving portion facing said lower opening.

6. The buttonhole sewing guiding device as claimed in claim 5, wherein said buttonhole presser foot unit further includes a biasing member disposed between said frame rear end portion and said sliding seat to bias said sliding member toward said frame rear end portion.

7. The buttonhole sewing guiding device as claimed in claim 5, wherein said presser frame has a penetrating slot which is formed between said frame front end portion and said frame rear end portion and which is elongated in the front-and-rear direction, said sliding member further having a connecting rod which is disposed on said sliding seat for removably connecting with the presser foot holder, said sliding seat being formed with a sewing opening which is aligned with said penetrating slot for passage of the sewing needle.

8. The buttonhole sewing guiding device as claimed in claim 4, wherein said lateral seat portion of said button guiding plate has an upper wall which is connected to said plate rear end portion and formed with a penetrating hole, a resilient flap which is disposed in said penetrating hole and has a fixed end integrally connected to said upper wall, a free end opposite to said fixed end, and a resilient protrusion formed on and extending downwardly from said free end, and two guide lateral walls which are disposed on and extend downwardly from an underside of said upper wall and which are spaced apart from each other in the left-and-right direction, said second triggering member further having a front stop portion which is disposed forwardly of said upper wall, a rear stop portion which is disposed rearwardly of said upper wall, and a connecting portion which extends in the front-and-rear direction to interconnect said front and rear stop portions and which is disposed between said guide lateral walls, said reflective portion extending rearwardly from said rear stop portion, said connecting portion having a plurality of teeth such that said resilient protrusion is engaged with a selected one of said teeth to retain said second triggering member to said button guiding plate.

9. The buttonhole sewing guiding device as claimed in claim 4, wherein said reflective portion is set to be distant from said reflective photoelectric switch in the front-and-rear direction by a predetermined distance when said button guide plate is in the non-use position and said presser frame is in the first sewing position, and by an operating distance when said button guide plate is in the use position and said presser frame is in the first sewing position, the operating distance being the sum of the predetermined distance and the gap interval.

10. The buttonhole sewing guiding device as claimed in claim 4, wherein said sensing module further has a signal cable disposed on said base seat and electronically connected between said reflective photoelectric switch and the central process unit to make communication therebetween, said first triggering member having a color different from that of said top surface of said lateral plate portion of said presser frame, said reflective portion of said second triggering member having a color different from that of said lateral plate portion.

* * * * *